US006216884B1

(12) United States Patent
Terry et al.

(10) Patent No.: US 6,216,884 B1
(45) Date of Patent: Apr. 17, 2001

(54) FABRIC BOLT HANGER

(75) Inventors: Larry K. Terry, Jonesboro; D. Deane Allinson, Paragould; Robert S. Old, Rector, all of AR (US)

(73) Assignee: L.A. Darling Company, Paragould, AR (US)

( * ) Notice: Subject to any disclaimer, the term of this patent is extended or adjusted under 35 U.S.C. 154(b) by 0 days.

(21) Appl. No.: 09/368,605

(22) Filed: Aug. 5, 1999

Related U.S. Application Data

(60) Provisional application No. 60/097,481, filed on Aug. 21, 1998.

(51) Int. Cl.[7] ..... A47F 5/00

(52) U.S. Cl. ..... 211/44; 211/113; 211/117; 248/317; 248/327

(58) Field of Search ..... 211/44, 113, 117, 211/118, 119; 248/317, 323, 327

(56) References Cited

U.S. PATENT DOCUMENTS

| | | | | |
|---|---|---|---|---|
| 1,563,429 | | 12/1925 | Miles . | |
| 2,222,190 | | 11/1940 | Wolf . | |
| 2,260,294 | | 10/1941 | Brown . | |
| 2,287,368 | | 6/1942 | Anderson . | |
| 2,957,672 | * | 10/1960 | Logan | 211/113 X |
| 3,133,683 | | 5/1964 | Deacon, Sr. . | |
| 3,272,345 | | 9/1966 | Wallace . | |
| 3,310,272 | * | 3/1967 | Brunger | 211/113 X |
| 3,627,141 | | 12/1971 | Kurland et al. . | |
| 3,727,751 | | 4/1973 | Bloch et al. . | |
| 3,739,918 | | 6/1973 | Kreitzburg . | |
| 4,018,340 | | 4/1977 | Gold . | |
| 4,823,962 | * | 4/1989 | Arias | 211/113 X |
| 4,919,281 | | 4/1990 | Ullman . | |
| 4,978,043 | * | 12/1990 | Uke | 211/113 X |
| 5,064,067 | | 11/1991 | McAllister et al. . | |
| 5,727,699 | * | 3/1998 | Gilcrease | 211/118 X |

FOREIGN PATENT DOCUMENTS

| | | |
|---|---|---|
| 175490 | 2/1935 | (CH) . |
| 634490 | 11/1927 | (FR) . |

* cited by examiner

*Primary Examiner*—Robert W. Gibson, Jr.
(74) *Attorney, Agent, or Firm*—Piper Marbury Rudnick & Wolfe

(57) ABSTRACT

A portable fabric bolt hanger in the form of a substantially planar frame includes an upper portion, a body portion, and a base. The upper and body portions fit inside the hollow core tube of a fabric bolt, so that the fabric bolt is supported by the base. A handhold and a hanging hook are formed in the upper portion so that the fabric bolt hanger supporting a fabric bolt may be easily handled and may be hung from conventional display racks. Hinges are provided in the hanger allowing the hanger to be folded and its length thereby adjusted.

29 Claims, 2 Drawing Sheets

FABRIC BOLT HANGER

This application claims the benefit of U.S. Provisional Application No. 60/097,481, filed Aug. 21, 1998.

BACKGROUND OF THE INVENTION

1. Field of the Invention

The present invention relates to the art of displaying and handling fabric bolts. More particularly, the present invention is directed to a portable hanger and a method of using the same for the convenient handling of fabric bolts and for the efficient display of fabric bolts from conventional store fixtures.

2. Description of Related Art

Fabric is typically sold at retail in the form of a fabric bolt, wherein the fabric is rolled on a hollow tube having closed ends. Such fabric bolts are often displayed in retail outlets either flat on tables or on wire frames. However, these types of display fixtures do not efficiently use the available merchandising space in that the space underneath the table or frame is unused. The use of such fixtures for the display of fabric bolts also makes the fabric bolts difficult for the consumers to view, select, and handle. Finally, because fabric bolts can be awkward to handle, such display fixtures can be difficult to load and unload.

Specialized display racks have also been suggested for merchandising fabric bolts. U.S. Pat. Nos. 2,222,190; 3,272,345; 3,739,918; and 4,018,340 each disclose racks wherein an upstanding loop of wire is attached to a horizontal support means such as a shelf or a pair of bars. A fabric bolt is slipped over the loop of wire so as to be supported and displayed in a generally vertical orientation.

Such display structures lack flexibility, however, in that the means for attaching the upstanding loop to the support is dependent on the type of rack that is used. For example, the cloth bolt holder of U.S. Pat. No. 3,739,918 includes a pair of feet which slidably engage the pair of bars that supports the upstanding loop. The shape and separation of the feet thus depend on the shape and separation of the pair of bars. As a result, the disclosed attachment means may not be useable with existing display racks. For example, these references do not disclose means for displaying fabric bolts from standard fixtures used to display hanging merchandise. The references also fail to disclose means for facilitating the loading and unloading of fabric bolts onto display racks.

Other fabric displays require the fabric to be wrapped around a support. For example, Ullman U.S. Pat. No. 4,919,281 discloses a fabric hanger having a generally rectangular frame that is provided with piercing hooks. To display a length of fabric, one end of the fabric is hooked onto the piercing hooks, the fabric is wrapped around the frame, and the trailing end of the fabric is also hooked on a piercing hook. Such structures do not efficiently display fabric bolts where the fabric is already rolled on a support such as a hollow tube.

SUMMARY OF THE INVENTION

The principle object of the present invention is to provide a fabric bolt hanger to allow for the display of fabric bolts in retail outlets in a manner that makes efficient use of available merchandising space.

Another object of the present invention is to provide a fabric bolt hanger that allows fabric bolts to be displayed from conventional store fixtures.

Yet another object of the present invention is to provide a portable fabric bolt hanger that allows for the convenient handling of fabric bolts, including the loading and unloading of fabric bolts onto display fixtures.

Still another object of the present invention is to provide a fabric bolt hanger which can accommodate fabric bolts of varying length.

A further object of the present invention is to provide a fabric bolt hanger having space for the affixation of a label identifying the fabric bolt.

A still further object of the present invention is to provide a method for displaying fabric bolts from display racks.

In accordance with the present invention, a fabric bolt hanger is provided which can be inserted into the hollow tube of a fabric bolt, thereby allowing the fabric bolt to be supported by the hanger and hung from a conventional display rack. The fabric bolt hanger includes a handhold so that the fabric bolt hanger supporting a fabric bolt may be easily handled. Hinges formed into the hanger allow for portions of the fabric bolt hanger to be folded, thereby adjusting its length.

DESCRIPTION OF THE PREFERRED EMBODIMENT

Figure 1:
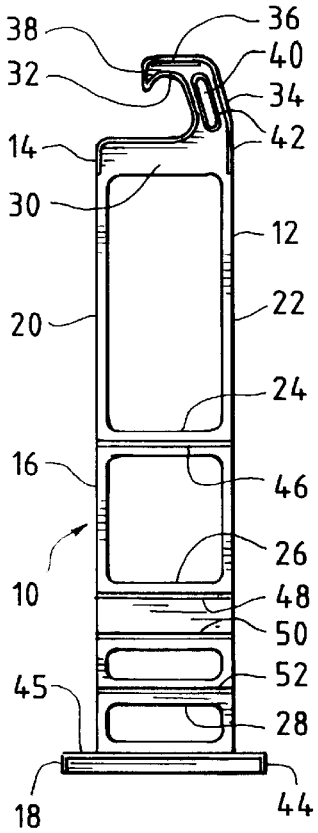
FIG. 1 is a front plan view of a fabric bolt hanger in accordance with the present invention.
Figure 2:
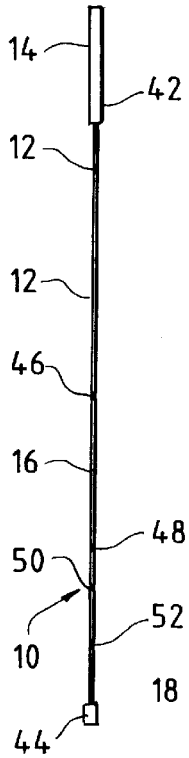
FIG. 2 is a right side plan view of a fabric bolt hanger in accordance with the present invention.

With reference to FIGS. 1 and 2, a fabric bolt hanger 10 in accordance with the present invention preferably comprises a substantially planar frame 12 having a generally rectangular shape. Fabric bolt hanger 10 is most conveniently made out of a single piece of injection molded plastic. Frame 12 has an upper portion 14, a body portion 16, and a base 18. Body portion 16 includes a left vertical member 20, a right vertical member 22, and crosspieces 24, 26, and 28, arranged so that the vertical members 20 and 22 are parallel to one another and are perpendicular to crosspieces 24, 26, and 28.

Upper portion 14 includes a label affixation area 30 with sufficient space for affixing a bar code, a tag, a label, or other such indicia (not shown) which may be used to identify the fabric bolt being merchandised. Extending upwardly from affixation area 30 is a hanging member 32. Hanging member 32 preferably takes the form of a hook which includes a vertical portion 34, a horizontal portion 36, and a downward tip 38. Other forms of hanging member 32 could be used, such as a hole (not shown) located in upper portion 14.

Upper portion 14 also includes a handhold, shown in FIG. 1 as an opening 40. Opening 40 is sized so as to receive the user's fingers, thus allowing the user to conveniently grip and carry the fabric hold hanger 10. Other forms of handhold could also be used, such as a handle (not shown) formed into upper portion 14.

Along the edges of upper portion 14 runs a reinforcement lip 42, wherein the material of upper portion 14 is made somewhat thicker. Reinforcement lip 42 also runs along the edge of opening 40. Preferably, reinforcement lip 42 is three times thicker than the rest of upper portion 14 and serves to add strength to upper portion 14.

Base 18 is wider than upper portion 14 and body portion 16, the widths of upper portion 14 and body portion 16 preferably being the same. A reinforcement lip 44 runs along the top and side edges of base 18, wherein the material is made thicker. A substantially planar surface 45 is defined by the portion of reinforcement lip 44 along the top of base 18. Preferably, reinforcement lip 44 is four times thicker than the rest of base 18.

Figure 3:
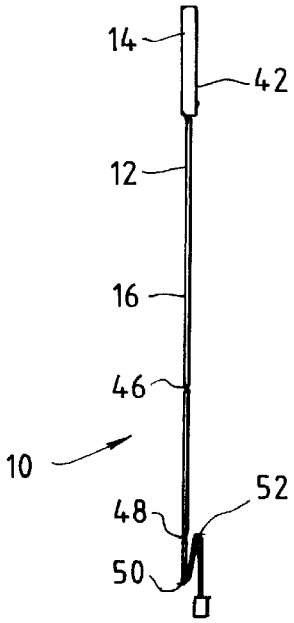
FIG. 3 is a right side plan view of a fabric bolt hanger folded to reduce its length in accordance with the present invention.

Running from the left side to the right side of crosspieces 24, 26, and 28, are hinges 46,48, 50, and 52, as shown in FIGS. 1 and 2. Hinges 46, 48, 50, and 52 may be formed by providing notches in the material of fabric bolt hanger 10. As shown in FIGS. 1 and 2, hinges 46 and 50 have notches cut into the front side of fabric bolt hanger 10, and hinges 48 and 52 have notches cut into the back side of fabric bolt hanger 10. Hinges 46, 48, 50, and 52 allow fabric bolt hanger 10 to be folded and its length adjusted thereby, as shown in FIG. 3.

Figure 4:
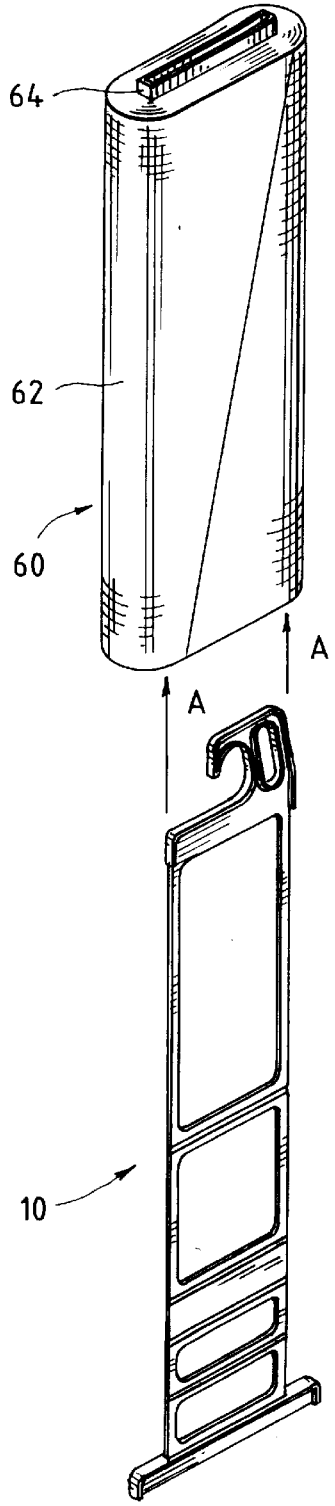
FIG. 4 is a perspective view of a fabric bolt hanger being inserted into a fabric bolt in accordance with the present invention.

Fabric bolt hanger 10 is intended to support a fabric bolt 60, as shown in FIG. 4. Fabric bolt 60 comprises a length of fabric 62 rolled on a hollow core tube 64 having a rectangular cross-section. section. Upper portion 14 and body portion 16 are sized to fit inside hollow core tube 64. However. base 18 is wider than hollow core tube 64 and will not fit therethrough.

Figure 5:
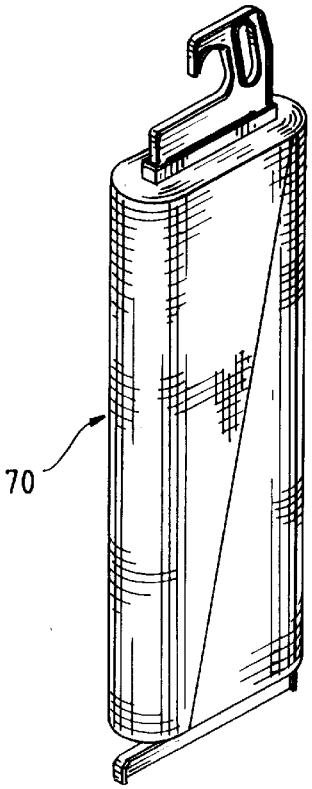
FIG. 5 is a perspective view of a fabric bolt display unit in accordance with the present invention.

As shown in FIGS. 4 and 5, fabric bolt hanger 10 is slipped inside hollow core tube 64 until fabric bolt 60 rests against substantially planar surface 45 of base 18, resulting in fabric bolt display unit 70. With reference to FIG. 4, arrows A show the general direction in which fabric bolt hanger 10 is inserted into fabric bolt 60. Typically, the ends 72 (one of which is shown in FIG. 4 and the other identical is identical to the one shown in FIG. 4) of core tube 64 are closed, in which case the ends 72 must be opened prior to inserting fabric bolt hanger 64. For example, if core tube 64 is made out of cardboard, as is typical, then ends 72 may be slit using a utility knife (not shown) or such other sharp object.

In fabric bolt display unit 70, fabric bolt 60 rests atop base 18, and upper portion 14, including label space 30, hanging member 34, and handhold 40, protrudes above the level of fabric bolt 60. In this way, handhold 40 is accessible and may be gripped for the easy lifting and handling of fabric bolt display unit 70. Hanging member 34 is also accessible so that fabric bolt display unit 70 may be hung therefrom.

Figure 6:
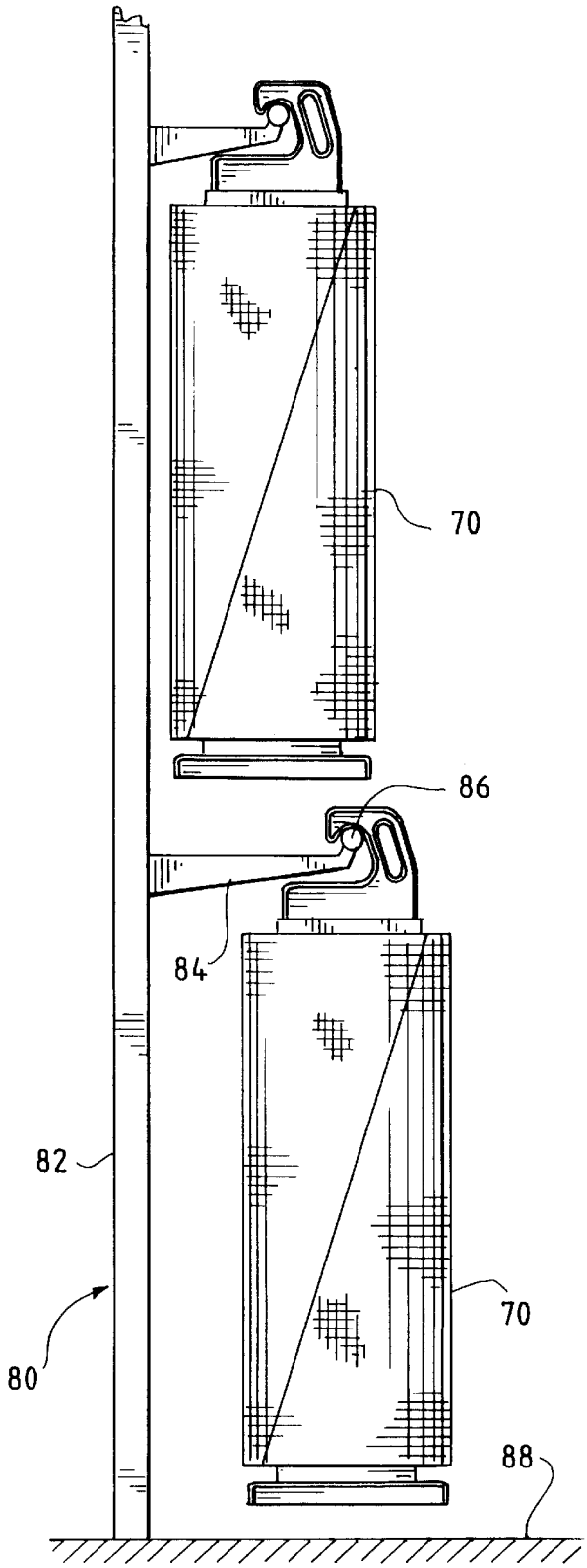
FIG. 6 is a pair of fabric bolt display units hung from a display rack in accordance with the present invention.

As shown in FIG. 6, fabric bolt display units 70 may be hung from a display rack 80, which may be any standard fixture used for displaying hanging merchandise. Display rack 80 includes an upright 82 and a horizontally extending bracket 84 which supports hang rod 86. Display rack 80 may be easily loaded with merchandise by lifting fabric bolt display unit 70 by handhold 40 and engaging hanging member 34 onto hang rod 84, so that fabric bolt display unit 70 is hung from hang rod 86 for display.

As shown in FIG. 6, display rack 80 may support multiple levels of fabric bolt display units 70. In this way, the space adjacent floor 88 may be used, leading to greater utilization of available merchandising space. As shown in FIGS. 5 and 6, the width of base 18 is approximately the width of fabric bolt 60, so that fabric bolt display units 70 may be displayed adjacent one another and close to upright 84 of display rack 80 for more efficient utilization of space.

The above described preferred embodiment is merely illustrative of the features and advantages of the present invention. Other arrangements and advantages may be devised by those skilled in the art without departing from the spirit and scope of the present invention. Accordingly, the invention should not be deemed to be limited to the above detailed description but only by the claims that follow.

We claim:

1. A portable fabric bolt hanger for carrying and displaying a fabric bolt, said fabric bolt including a length of fabric rolled on a hollow tube, said hollow tube having an inside width, comprising:

a substantially planar frame having an upper portion, said upper portion having a width which is less than said inside width, said upper portion including a hanging member, a body portion, said body portion having a width which is less than said inside width, wherein said body portion includes at least one hinge so that a length of said body portion may be adjusted, and a base, said base having a width which is greater than said inside width, whereby said fabric bolt hanger may be inserted into said hollow tube of said fabric bolt so that said fabric bolt rests on said base and said upper portion and said hanging member are accessible above said fabric bolt.

2. The fabric bolt hanger of claim 1, wherein said hanging member includes a hook.

3. The fabric bolt hanger of claim 1, wherein said upper portion includes a handhold.

4. The fabric bolt hanger of claim 1, wherein said upper portion defines an opening for a handhold.

5. The fabric bolt hanger of claim 1, wherein said body portion is rectangular.

6. The fabric bolt hanger of claim 1, wherein said upper portion includes a label affixation area.

7. The fabric bolt hanger of claim 1, wherein said hanger is a single injection-molded piece.

8. The fabric bolt hanger of claim 1, wherein said hanger is formed of a pliable material.

9. A portable fabric bolt hanger for carrying and displaying a fabric bolt, comprising:

a left vertical member having a top end and a bottom end;

a right vertical member having a top end and a bottom end, said right vertical member being substantially parallel to said left vertical member;

an upper member joining said top end of said left vertical member and said top end of said right vertical member, said upper member and said left and right vertical members defining a first width, said upper member including a hanging member; and a base joining said bottom end of said left vertical member and said bottom end of said right vertical member, said base having a second width greater than said first width and said second width being approximately the width of said fabric bolt.

10. The fabric bolt hanger of claim 9, wherein said upper member includes a handhold.

11. The fabric bolt hanger of claim 9, wherein said upper member has an opening for a handhold.

12. The fabric bolt hanger of claim 9, wherein said upper member includes a label affixation area.

13. The fabric bolt hanger of claim 9, wherein said hanger is a single injection-molded piece.

14. The fabric bolt hanger of claim 9, wherein said hanger is formed of a pliable material.

15. A fabric bolt display unit, comprising:

a fabric bolt, said fabric bolt including a length of fabric rolled on a hollow tube; and a substantially planar frame having an upper portion, said upper portion having a hanging member, a body portion, and a base, said frame being inserted in said hollow tube with said fabric bolt supported on said base and said upper portion accessible above said fabric bolt.

16. The fabric bolt display unit of claim 15, wherein said upper portion includes a handhold.

17. The fabric bolt display unit of claim 15, wherein said upper portion has an opening for a handhold.

18. The fabric bolt display unit of claim 15, wherein said upper portion includes a label affixation area.

19. A method of displaying a fabric bolt, said fabric bolt including a length of fabric rolled on a hollow tube, said hollow tube having an inside width and first and second ends, comprising the steps of:

providing a support member having a base and a hanging member, said base being wider than said inside width; and inserting said support member into said hollow tube so that said fabric bolt is resting on said base and said hanging member is accessible above said fabric bolt.

20. The method of claim 19 further comprising the step of:

opening said first and second ends of said hollow tube.

21. A portable fabric bolt hanger for carrying and displaying a fabric bolt, said fabric bolt including a length of fabric rolled on a hollow tube, said hollow tube having an inside width, comprising:

a substantially planar frame having an upper portion, said upper portion having a width which is less than said inside width, said upper portion including a hanging member, a body portion, said body portion having a width which is less than said inside width, and a base, said base having a width which is greater than said inside width, wherein said upper portion and said base each includes a reinforced edge, whereby said fabric bolt hanger may be inserted into said hollow tube of said fabric bolt so that said fabric bolt rests on said base and said upper portion and said hanging member are accessible above said fabric bolt.

22. A portable fabric bolt hanger for carrying and displaying a fabric bolt, comprising:

a left vertical member having a top end and a bottom end;

a right vertical member having a top end and a bottom end, said right vertical member being substantially parallel to said left vertical member;

an upper member joining said top end of said left vertical member and said top end of said right vertical member, said upper member and said left and right vertical members defining a first width, said upper member including a hanging member, said hanging member including a hook; and a base joining said bottom end of said left vertical member and said bottom end of said right vertical member, said base having a second width greater than said first width and said second width being approximately the width of said fabric bolt.

23. A portable fabric bolt hanger for carrying and displaying a fabric bolt, comprising:

a left vertical member having a top end and a bottom end;

a right vertical member having a top end and a bottom end, said right vertical member being substantially parallel to said left vertical member;

an upper member joining said top end of said left vertical member and said top end of said right vertical member, said upper member and said left and right vertical members defining a first width, said upper member including a hanging member;

at least one crosspiece joining said left vertical member and said right vertical member; and a base joining said bottom end of said left vertical member and said bottom end of said right vertical member, said base having, a second width greater than said first width and said second width being approximately the width of said fabric bolt.

24. The fabric bolt hanger of claim 23, further comprising at least one hinge extending through said left vertical member, said cross piece, and said right vertical member.

25. A portable fabric bolt hanger for carrying and displaying a fabric bolt, comprising:

a left vertical member having a top end and a bottom end;

a right vertical member having a top end and a bottom end, said right vertical member being substantially parallel to said left vertical member;

an upper member joining said top end of said left vertical member and said top end of said right vertical member, said upper member and said left and right vertical members defining a first width, said upper member including a hanging member; and a base joining said bottom end of said left vertical member and said bottom end of said right vertical member, wherein said upper member and said base each includes a reinforced edge, said base having a second width greater than said first width and said second width being approximately the width of said fabric bolt.

26. A fabric bolt display unit, comprising:

a fabric bolt, said fabric bolt including a length of fabric rolled on a hollow tube; and a substantially planar frame having an upper portion, said upper portion having a hanging member, said hanging member includes a hook, a body portion, and a base, said frame being inserted in said hollow tube with said fabric bolt supported on said base and said upper portion accessible above said fabric bolt.

27. A fabric bolt display unit, comprising:

a fabric bolt, said fabric bolt including a length of fabric rolled on a hollow tube; and a substantially planar frame having an upper portion, said upper portion having a hanging member, a body portion, said body portion including a hinge, and a base, said frame being inserted in said hollow tube with said fabric bolt supported on said base and said upper portion accessible above said fabric bolt.

28. A method of displaying a fabric bolt, said fabric bolt including a length of fabric rolled on a hollow tube, said hollow tube having an inside width and first and second ends, comprising the steps of:

providing a support member having a base, a hanging member, said base being wider than said inside width;

inserting said support member into said hollow tube so that said fabric bolt is resting on said base and said hanging member is accessible above said fabric bolt; and hanging said hanging member from a display rack, so as to display said fabric bolt on said support member.

29. The method of claim 28 further comprising the steps of:

providing a handhold in said support member; and lifting said support member by said handhold prior to the step of hanging said hanging member from a display rack.

* * * * *